US006858805B2

(12) United States Patent
Blew et al.

(10) Patent No.: US 6,858,805 B2
(45) Date of Patent: Feb. 22, 2005

(54) CABLE WITH FOAMED PLASTIC INSULATION COMPRISING AND ULTRA-HIGH DIE SWELL RATIO POLYMERIC MATERIAL

(75) Inventors: Douglas J. Blew, Mooresville, NC (US); Eddy R. Houston, Maiden, NC (US)

(73) Assignee: CommScope Properties LLC, Sparks, NV (US)

( * ) Notice: Subject to any disclaimer, the term of this patent is extended or adjusted under 35 U.S.C. 154(b) by 0 days.

(21) Appl. No.: 10/431,953

(22) Filed: May 8, 2003

(65) Prior Publication Data

US 2004/0222009 A1 Nov. 11, 2004

(51) Int. Cl.[7] ..... H01B 7/00

(52) U.S. Cl. ..... 174/100; 174/117 AS; 174/121 R; 174/121 B

(58) Field of Search ..... 174/100, 117 AS, 174/121 R, 121 B

(56) References Cited

U.S. PATENT DOCUMENTS

| | | | |
|---|---|---|---|
| 4,547,328 | A | 10/1985 | Yuto et al. |
| 4,683,166 | A | 7/1987 | Yuto et al. |
| 5,254,188 | A | 10/1993 | Blew |
| 5,346,926 | A | 9/1994 | Sakamoto et al. |
| 5,959,245 | A | 9/1999 | Moe et al. |
| 6,137,058 | A | 10/2000 | Moe et al. |
| 6,201,189 | B1 | 3/2001 | Carlson et al. |
| 6,265,667 | B1 | 7/2001 | Stipes et al. |
| 6,492,596 | B1 | 12/2002 | Higashikubo et al. |

FOREIGN PATENT DOCUMENTS

| | | |
|---|---|---|
| GB | 2 013 960 A | 8/1979 |

*Primary Examiner*—Dean A. Reichard
*Assistant Examiner*—Jinhee Lee
(74) *Attorney, Agent, or Firm*—Alston & Bird LLP

(57) ABSTRACT

An electrical communications element having a foamed plastic insultation extruded about a conductor with said insulation including at least one component with more than 20% by weight of an ultra-high die swell ratio polymer (UHDSRP), preferably around 15% by weight. The UHD-SRP is defined as greater than 55% die swell ratio and more preferably greater than 65% die swell ratio. The insulation also preferably includes at least a second component with a high degree of stress crack resistance, such that the combination of (minimally) these polymers will yield an insulation layer that has a unique combination of physical propeties yielding a high degree of foaming, small uniform cell structure, characteristically lower attenuation, and stress crack resistance capable of withstanding greater than 100 hours at 100° C. while coiled at a stress level of 1 times the insulation outside diameter without failure (cracking).

24 Claims, 5 Drawing Sheets

CABLE WITH FOAMED PLASTIC INSULATION COMPRISING AND ULTRA-HIGH DIE SWELL RATIO POLYMERIC MATERIAL

FIELD OF THE INVENTION

The present invention is directed generally to communications cables, and more specifically to cables with highly expanded foam of a uniform, small, and closed cell nature.

BACKGROUND OF THE INVENTION

It has been taught by Yuto and Suzuki (U.S. Pat. Nos. 4,547,328 and 4,683,166) that the addition of at least 20% by weight of a 55% or greater die swell ratio (DSR) plastic to a polymer blend produces certain advantages in the making of coaxial cable. Specifically, the addition of the 55% or greater DSR polymer increases the elasticity of the melted polymer, allowing better control over the process whereby wire is coated with a foamed insulation. The teachings indicate that advantages are obtained from a high degree of foaming (expansion ratio) and a cell structure of the foamed polymer that is 50 microns or less. Small cell structures at high expansion ratios are desirable for the properties of low electrical loss (attenuation), low material usage and improved mechanical strength. It is understood by those skilled in the art that the prior art had to restrict the 55% or greater DSR material to no less than 20% of the total mixture in order to maintain aforementioned desirable cell structure, high expansion ratio, and stress crack resistance. However, in order to enhance dimensional stability and mechanical strength of the cable, the foamed insulation layer was coated with an unfoamed solid polymer layer or skin. It is known that such a layer adds complexity to the manufacturing process and increases the cost of initial capital and ongoing material usage. Additionally, the high DSR materials themselves are electrically disadvantaged, and thus adversely affect the electrical purity (dissipation factor) of the cable.

SUMMARY OF THE INVENTION

The present invention provides electrical communications elements, such as wires and cables, having a superior combination of low dissipation factor, and high thermally accelerated stress crack resistance in either solid or preferably, foamed states. This novel combination of properties achieves the following unique and advantageous characteristics concurrently in the same structure:

- A high degree of foaming of at least 50% and more preferably between 50% and 85%.
- A foam structure of fine and uniform cells that are closed in nature and are preferably smaller than 100 microns, yielding excellent mechanical crush resistance.
- A thermally accelerated stress crack resistance performance capable of passing lifetime tests familiar in the industry, such as withstanding greater than 100 hours at 100° C. while coiled at a stress level of 1 times the insulation outside diameter without failure.
- An attenuation level lower than that possible with prior embodiments requiring electrically disadvantaged plastics characteristic of a DSR greater than 55% at blend ratios of at least 20% by weight.
- A lesser weight of plastic, hence a lower cost for the communications element as compared to prior art communication elements of similar purpose and end use.

According to the present invention, an electrical communications element is provided that comprises a conductor and a surrounding foamed plastic insulation. The foamed plastic insulation comprises no more than 20% by weight of a polymer having an ultra-high die swell ratio greater than 55%. Preferably, the ultra-high die swell polymer is blended with one or more electrically and/or environmentally superior additional polymer compositions to achieve desirable mechanical, electrical, thermal, lifetime properties and cost advantages that heretofore have physically not been able to exist simultaneously in the same embodiment. More particularly, the additional polymer compositions have a high thermally accelerated stability as defined by an oxidative induction time (OIT) of greater than 15 minutes at 200° C. according to ASTM method 4568. More desirably, the additional polymer composition has an oxidative induction time of greater than 20 minutes.

Preferably, the additional polymer composition has a dissipation factor lower than that of the ultra high die swell ratio polymer and less than 75 micro radians, and more desirably less than 50 micro radians.

The insulation provided by the present invention has a thermally accelerated stress crack resistance of greater than 100 hours at 100° C. while coiled at a stress level of 1 times the insulation outside diameter without exhibiting radial or longitudinal cracks.

In one preferred aspect, the foamed plastic insulation comprises about 15% by weight of an olefin polymer having a die swell ratio with a value greater than 55%. In a further preferred aspect, the foamed plastic insulation comprises no more than 20% by weight of a low density polyethylene having a die swell ratio greater than 55% and at least one additional polyolefin composition having a high thermally accelerated stability defined by an oxidative induction time (OIT) of greater than 15 minutes at 200° C. according to ASTM method 4568. Preferably, the least one additional polyolefin composition has a dissipation factor lower than that of the high die swell ratio low density polyethylene and less than 75 micro radians.

The insulated electrical communications element of the present invention can be embodied in various kinds of structures used for electrical communications, such as coaxial cables, drop cables or twisted pair cables.

In a further embodiment, the present invention provides an electrical communications cable comprising a conductor and a surrounding foamed plastic insulation. The foamed plastic insulation comprises a blend of a first polyolefin having an ultra high die swell ratio with a value greater than 55% present in an amount no more than 20% by weight and at least one additional polyolefin having a high thermally accelerated stability as defined by an oxidative induction time (OIT) of greater than 15 minutes at 200° C. according to ASTM method 4568. Preferably the at least one additional polyolefin has a dissipation factor lower than the ultra high die swell ratio polyolefin and less than 75 micro radians. The additional polyolefin may suitably be a highly stabilized polyolefin including phenolic antioxidants or phenolic antioxidant-phosphite blends as well as a hindered amine light stabilizer.

BRIEF DESCRIPTION OF THE DRAWINGS

Some of the features and advantages of the invention having been described, others will become apparent from the detailed description which follows, and from the accompanying drawings, in which.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
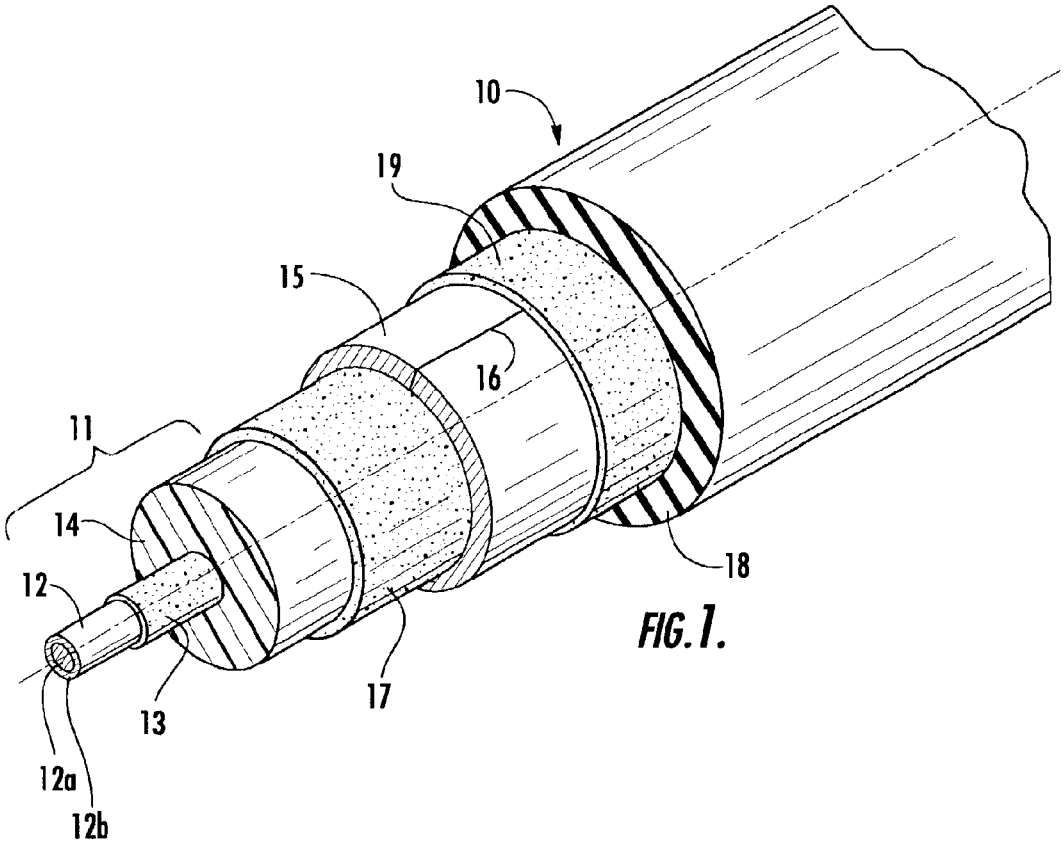
FIG. 1 is a perspective cutaway view showing a coaxial cable in accordance with the present invention.

FIG. 1 illustrates an insulated electrical communications element in accordance with the present invention embodied in a coaxial cable 10. The coaxial cable comprises a cable core 11 which includes an inner conductor 12 of a suitable electrically conductive material and a surrounding continuous cylindrical wall of expanded foam plastic dielectric material 14. The dielectric 14 is an expanded cellular foam composition. Preferably, the cells of the dielectric 14 are of a closed-cell configuration and of uniform size, typically less than 200 microns in diameter, and more desirably less than 100 microns. Preferably, the foam dielectric 14 is adhesively or frictively bonded to the inner conductor 12 by a thin layer of adhesive or frictive material 13. The inner conductor 12 may be formed of solid copper, copper tubing, copper-clad steel, copper-clad aluminum, or other conductors being solid, hollow or stranded in construction. The inner conductor preferably has a smooth surface but may also be corrugated. In the embodiment illustrated, only a single inner conductor 12 is shown, but it is to be understood that the present invention is applicable also to cables having more than one inner conductor insulated from one another and forming a part of the core 10. Furthermore, in the illustrated embodiment, the inner conductor 12 is a wire formed of an aluminum core 12*a* with a copper outer cladding layer 12*b*.

Closely surrounding the core 11 is a continuous tubular smooth-walled sheath 15. In the preferred embodiment illustrated, the tubular sheath 15 is made from an aluminum strip that has been formed into a tubular configuration with the opposing side edges of the strip butted together, and with the butted edges continuously joined by a continuous longitudinal weld, indicated at 16. The welding may be carried out generally as described in U.S. Pat. Nos. 4,472,595 and 5,926,949 which are incorporated herein by reference. While production of the sheath 14 by longitudinal welding has been illustrated as preferred, persons skilled in the art will recognize that other methods for producing a mechanically and electrically continuous thin walled tubular bimetallic sheath could also be employed. Preferably, the inner surface of the tubular sheath 15 is continuously bonded throughout its length and throughout its circumferential extent to the outer surface of the foam dielectric 14 by a thin layer of adhesive 17. A preferred class of adhesive for this purpose is a random copolymer of ethylene and acrylic acid (EAA) or EAA blended with compatible other polymers. The outer surface of the sheath 15 is surrounded by a protective jacket 18. Suitable compositions for the outer protective jacket 18 include thermoplastic coating materials such as polyethylene, polyvinyl chloride, polyurethane and rubbers. In the embodiment illustrated, the protective jacket 18 is preferably bonded to the outer surface of the sheath 15 by an adhesive layer 19 to thereby increase the bending properties of the coaxial cable. Preferably, the adhesive layer 19 is a thin layer of adhesive, such as the EAA copolymer or blends described above. Although an adhesive layer 19 is illustrated in the drawing, the protective jacket 18 can also be directly bonded to the outer surface of the sheath 15.

Figure 2:
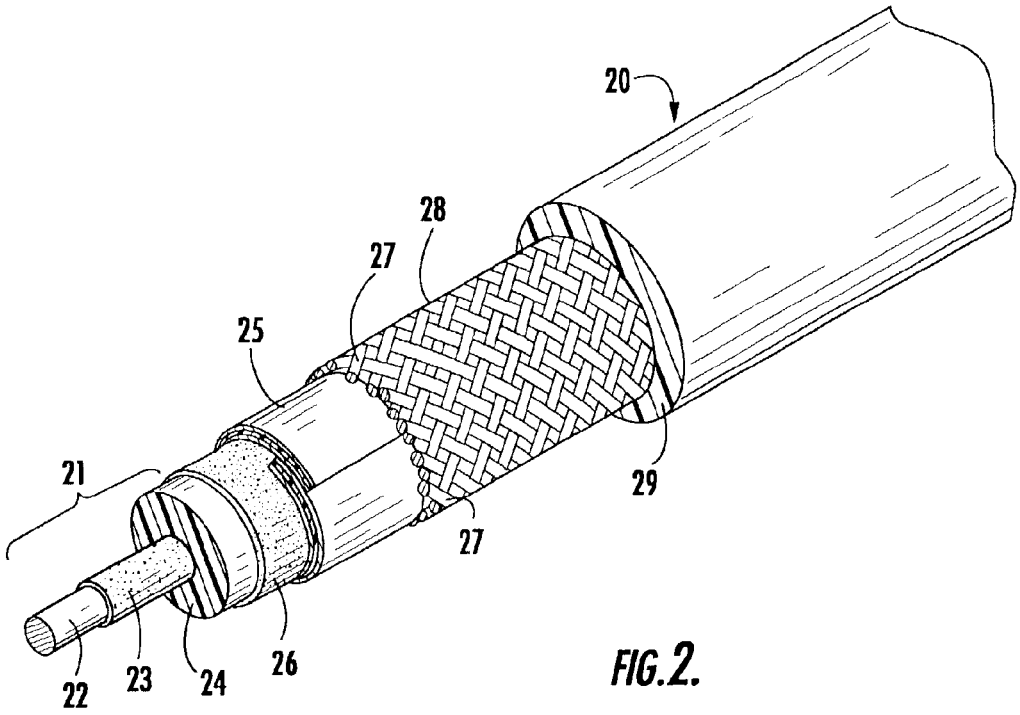
FIG. 2 is a perspective cutaway view showing a drop cable in accordance with the present invention.

Referring now to FIG. 2, there is shown another example of an electrical communications element in accordance with the present invention embodied in a drop cable 20 of the type used in the transmission of RF signals such as cable television signals, satellite signals, cellular telephone signals, data and the like. The cable 20 includes a cable core 21 comprising an elongate inner conductor 22 and a dielectric layer 24 surrounding the inner conductor. Preferably, the dielectric layer 24 is bonded to the inner conductor 22 by an adhesive layer 23 formed, for example, of an ethylene-acrylic acid (EAA), ethylene-vinyl acetate (EVA), or ethylene methylacrylate (EMA) copolymer or other suitable adhesive or frictive material. Preferably, the inner conductor 22 is formed of copper clad steel wire but other conductive wire (e.g. copper) can also be used. The dielectric layer 24 is a foamed polymer that is continuous from the inner conductor 22 to the adjacent overlying layer, but may also exhibit an outer solid layer or skin. An electrically conductive shield 25 is applied around the dielectric layer 24. The conductive shield 25 is preferably bonded to the dielectric layer 24 by an adhesive layer 26. The adhesive layer 26 can be formed of any of the materials discussed above with respect to adhesive layer 23. The conductive shield 25 advantageously prevents leakage of the signals being transmitted by the inner conductor 22 and interference from outside signals. The conductive shield 25 is preferably formed of a shielding tape that extends longitudinally along the cable. Preferably, the shielding tape is longitudinally applied such that the edges of the shielding tape are either in abutting relationship or are overlapping to provide 100% shielding coverage. More preferably, the longitudinal edges of the shielding tape are overlapped. The shielding tape includes at least one conductive layer such as a thin metallic foil layer. Preferably, the shielding tape is a bonded laminate tape including a polymer inner layer with metal outer layers bonded to opposite sides of the polymer inner layer. The polymer inner layer is typically a polyolefin (e.g. polypropylene) or a polyester film. The metal layers are typically thin aluminum foil layers. A plurality of elongate wires 27 surrounds the conductive shield 25. The elongate wires 27 are preferably interlaced to form a braid 28, but may instead be overlapping in a bidirectional manner, be unidirectionally served, or may be of an oscillated arrangement (termed SZ or ROL in the industry). The elongate wires 27 are metal and are preferably formed of aluminum or an aluminum alloy but can be formed of any suitable material such as copper or a copper alloy. A cable jacket 29 surrounds the braid 28 and protects the cable from moisture and other environmental effects. The jacket 29 is preferably formed of a non-conductive material such as polyethylene or polyvinyl chloride. It should be understood that multiple elongate foil shields and multiple elongate wire layers could be mixed and matched to achieve additional electrical shielding and/or mechanical strength.

Figure 3:
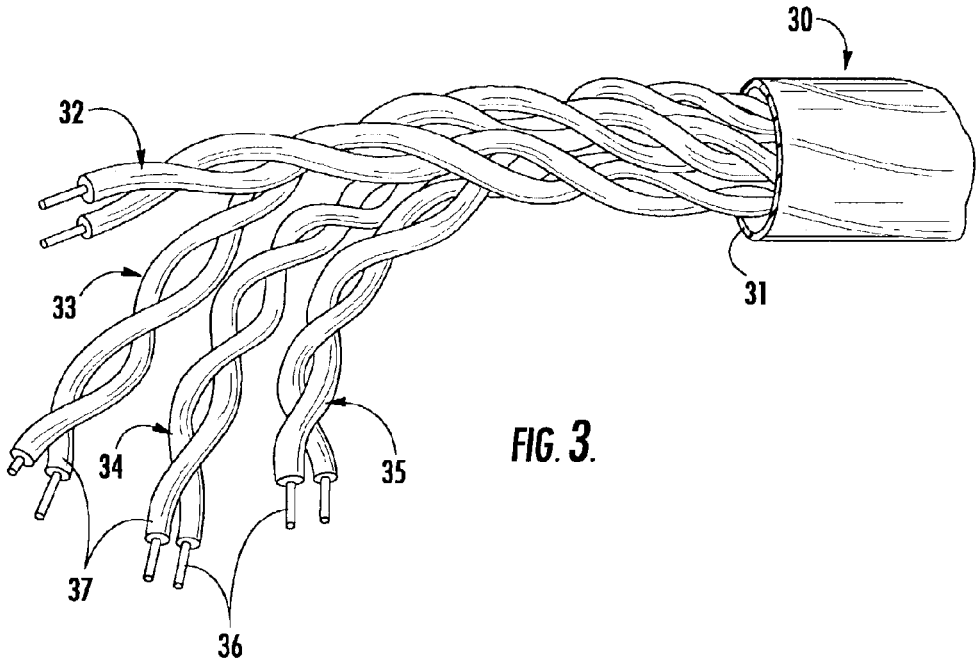
FIG. 3 is a perspective view showing a twisted pair cable in accordance with the present invention.

Referring now to FIG. 3, there is shown yet another illustration of an electrical communications element according to the present invention, embodied in a multi-pair communications cable 30. The cable 30 has a tubular cable jacket 31 which surrounds four twisted pairs of insulated conductors 32, 33, 34 and 35. The jacket 31 is made of a flexible polymer material and is preferably formed by melt extrusion. Any of the polymer materials conventionally used in cable construction may be suitably employed. Each insulated conductor in the twisted pair comprises a conductor 36 surrounded by a layer of an insulating material 37. The conductor 36 may be a metallic wire or any of the well-known metallic conductors used in wire and cable applications, such as copper, aluminum, copper-clad aluminum, and copper-clad steel. Preferably, the wire is 18 to 26 AWG gauge. Preferably, the thickness of the insulating material 37 is less than about 25 mil, preferably less than about 15 mil, and for certain applications even less than about 10 mil.

According to the present invention, the insulated electrical communications element is produced by extruding a foamable polymer composition around a conductor and causing the composition to foam and expand. The foaming process can use chemical and/or mechanical blowing agents, such as nitrogen, conventional in the wire and cable industry for producing foam insulation. The polymer composition comprises no more than 20% by weight of a polymer having an ultra-high die swell ratio greater than 55%. The presence of the ultra-high die swell polymer provides excellent foaming properties for the insulation. Preferably, the polymer composition includes at least one additional polymer that is selected for its superior electrical and/or environmental stability characteristics. Polymers suitable for use in the present invention may be selected from any of a number of commercially available polymer compositions conventionally used in the wire and cable industry, including polyolefins such as polypropylene and low, medium and high density polyethylene. Particularly preferred for use as the ultra-high die swell ratio component is low density polyethylene, preferably a polyethylene with a density within the range of about 0.915 g/cm$^3$ to about 0.930 g/cm$^3$. The additional polymer component is preferably a medium and/or high density polyethylene. Preferably, this additional polymer has a high thermally accelerated stability as defined by an oxidative induction time (OIT) of greater than 15 minutes at 200° C. according to ASTM method 4568.

The ability of a strained polymeric molecular chain to store energy will impact the amount of swell that takes place following the affects of temperature and work. A polymer such as low density polyethylene (LDPE) with longer chains and side branching will store more energy and recover at a higher rate after processing than that of similar molecular weight LDPE with shorter chains and less side branching. The measurement of the recovery can be determined by the die swell ratio (DSR), which can be determined by the following relation:

$$DSR(\%)=[(d_s-d_o)/d_o\times 100]$$

Where $d_s$ is an outer diameter of the extruded material and $d_o$ is an inner diameter of an orifice provided in an extrusion plastometer defined in ASTM D1238. $d_s$ and $d_o$ may be obtained during measurement of melt index (MI) by an extrusion plastometer. The diameter of the orifice is measured at room temperature, usually before heating of the device. The resultant diameter of the extrudate is measured after it is allowed to cool to room temperature. Typical settings for the ASTM D1238 test, utilizing low density polyethylene, are a temperature of 190° C. and a 2160 gram load.

It is theorized that molecular weight distribution (Mw/Mn) also plays an important role in the identification of high die swell properties. In the scope of this investigation it was shown the LDPE compounds having a MWD of eight (8) or higher yielded significantly higher die swell and melt elasticity—desirous for the formation of low density foamed dielectric insulation of communications elements. While these properties are more inherent to those LDPE resins manufactured using an autoclave reaction process, LDPE resins produced by certain tubular or other reactor products may yield similar performance. Polydispersity or ER value as defined by Equistar Chemicals is also an indicator of the melt elasticity of the polyethylene product. The procedure for measurement of ER value is described in an article by R. Shroff, et al. entitled "New Measures of Polydispersity from Rheological Data on Polymer Melts", J. Applied Polymer Science, Vol. 57, pp. 1605–1626 (1995) and in U.S. Pat. No. 5,534,472, both of which are incorporated herein by reference. As shown in table 1, high die swell materials correlate with increased ER values and better foaming results.

TABLE 1

Results of Die Swell of LDPE Components

| Material | DSR (%) | MWD | Polydispersity (ER value) | Foaming |
|---|---|---|---|---|
| LDPE #1 | 51 | 7.1 | 1.44 | Poor |
| LDPE #2 | 61 | 8.0 | 1.58 | Good |
| LDPE #3 | 76 | 9.9 | 2.34 | Excellent |

In the course of this experimentation, a list of primary polyethylene compounds (HDPE) and secondary high die swell low-density polyethylene compounds were evaluated for electrical performance in terms of the electrical dissipation factor of a molded 75-mil (0.075 inch) specimen. This parameter is also interchangeably referred to as a material's Loss Tangent. An HP/Agilent 4342A Model Q Meter was used to measure the dissipation factor and dielectric constant at a frequency of 1 megahertz (MHz). Typically this measurement is stated in units of micro-radians or a value times $10^{-6}$ radians.

The LDPE component is specified to be "neat"; that is, having little or no antioxidants, UV stabilizers, slip, or antiblocking additives. LDPE resins containing high levels of stabilizers or process aids will not meet the electrical criteria and heat aging properties established for optimal attenuation properties. In this respect, the HDPE component of the foam dielectric blend contains, minimally, the environmental stabilizers and antioxidants required to provide long term thermally accelerated stability and thermally accelerated stress crack resistance of the HDPE/LDPE foam blend. It is important to note that while stabilizers are required for lifetime performance, the addition of such stabilizers will typically negatively impact electrical attenuation. To accomplish the desired environmental stabilization with optimal attenuation properties, a preferred system consists of a primary high-performance phenolic antioxidant such as Irganox 1010 or 1076 (Ciba Chemicals) and a secondary Phosphite co-stabilizer such as Irgafos 168 (Ciba Chemicals). The combination of the primary and secondary antioxidants provides a synergistic effect and impacts the long-term thermally accelerated stability of the foam product. Furthermore, the stabilizer system preferably includes a third multifunctional long-term stabilizer belonging to the family of hindered amine light stabilizers (HALS), which provides additional long term environmental stability and weathering (UV) protection. Given the levels required for effective UV stabilization, it was theorized that the additional HALS loading would have a negative impact on the dissipation factor (hence attenuation) of HDPE used in the manufacture of coaxial cables. Test results as shown in Table 2 demonstrate that the dissipation factors of HDPE compounds containing the various blends of primary and secondary antioxidants and HALS do not follow this predicted theory.

The blend of antioxidants and HALS used in this particular development is described as follows:

Irganox 1010 phenolic antioxidant—200 ppm target

Irgafos 168 phenolic antioxidant phosphite blend—400 ppm target

Chimassorb 944 or Tinuvin 622 hindered amine light stabilizer—400 ppm target.

Calcium Stearate—600 ppm

Commercial blends such as Irganox B215 (Ciba) are attainable which can also provide the correct ratio of primary and secondary antioxidants. It should be evident that other blends of similar components from alternate manufacturers in various other concentrations will also serve to describe the state of material.

TABLE 2

Descriptions of Antioxidant Systems and Dissipation Factors

| Component Description | Dissip. Factor (micro-rads) | MW | Mw/Mn | OIT min @ 200 C. | Comments |
|---|---|---|---|---|---|
| HDPE - A | 15 | 79500 | 6.7 | 36 minutes | 0.963 density (400 ppm 1010 and 600 ppm CaSt) |
| HDPE - B | 12 | 76400 | 5.1 | 17 minutes | 0.952 density (400 ppm 1076 and 600 ppm CaSt) |
| HDPE - C | 19 | 76400 | 5.1 | 22 minutes | HDPE B with Combination AO/HAL Stab Package |
| HDPE - D | 17 | 79500 | 6.7 | 36 minutes | HDPE A with Combination AO/HAL Stab Package |
| LDPE 1 | 115 | 95000 | 5.3 | <2 minutes | 51 DSR |
| LDPE 2 | 41 | 147000 | 8.0 | <2 minutes | 61 DSR |
| LDPE 3 | 77 | 18000 | 9.9 | <2 minutes | 76 DSR |

Figure 4:
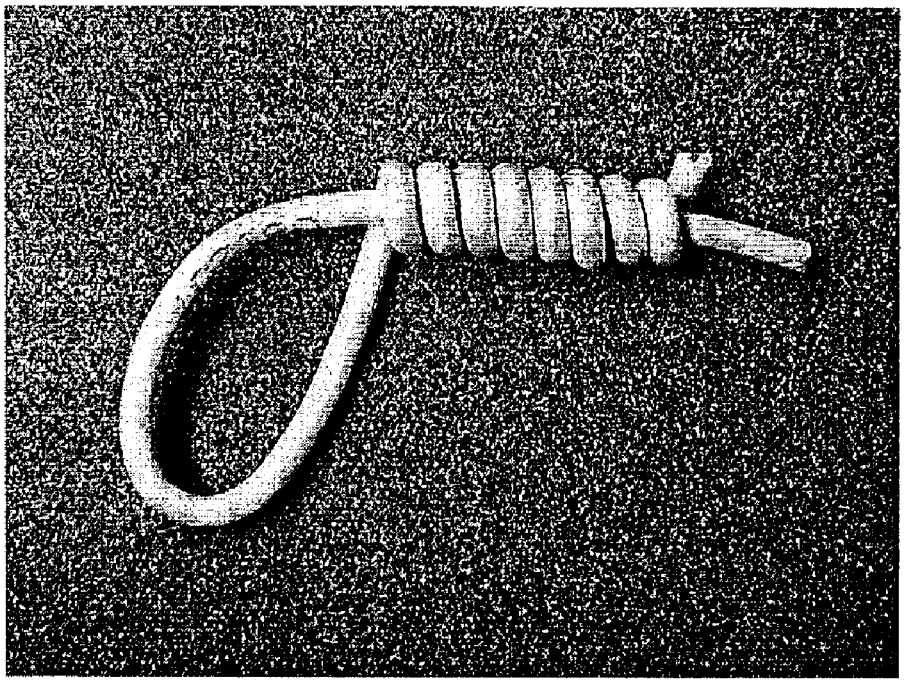
FIG. 4 is a photograph showing a thermally accelerated stress crack specimen before testing.
Figure 5:
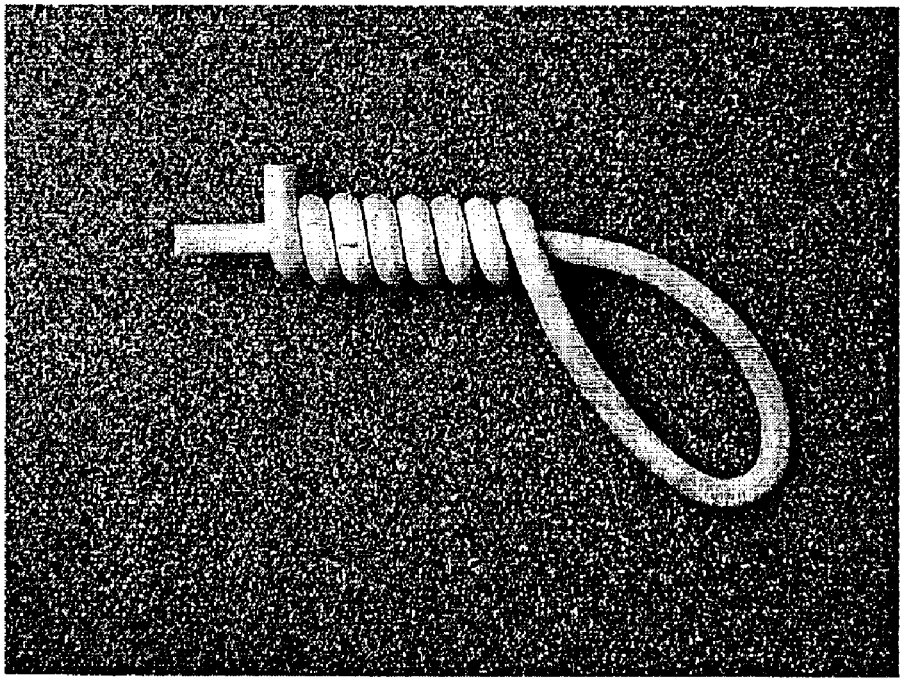
FIG. 5 is a photograph showing a thermally accelerated stress crack specimen after testing to a level of failure with cracks being visible.

The thermally accelerated stress crack resistance of a 0.180-inch diameter foam coaxial member having a 0.0403-inch copper clad steel center conductor was tested per the prescribed test method of wrapping the foamed core about a mandrel that has a diameter of one times the diameter of the element under test. This places the test specimen in a predetermined stress level that is proportionate to its diameter. As shown in FIG. 4, a length of cable core comprising an inner conductor surrounded by a foam dielectric is formed into a loop and wound snugly about a standing portion of the cable core. This prepared specimen is then subjected to a temperature of 100° C. and is monitored periodically until cracks are observed, as seen in FIG. 5. The results of these tests showing the impact of the (1) the inclusion of higher DSR LDPE and (2) the combination of primary and secondary antioxidants along with the HALS are shown in Table 3:

TABLE 3

Thermally accelerated Stress Crack Resistance

| Material (from table 2) | Ratio (HD/LD) | Actual Density (gm/cc) | Thermally accelerated Stress Crack resist (% failure @ hours) |
|---|---|---|---|
| HDPE - B and LDPE 2 | 85/15 | 0.328 | 0% @ 1344 hours |
| HDPE - D and LDPE 2 | 85/15 | 0.332 | 0% @ 912 hours |
| HDPE - C and LDPE 2 | 85/15 | 0.340 | 0% @ 2472 Hours |

TABLE 3-continued

Thermally accelerated Stress Crack Resistance

| Material (from table 2) | Ratio (HD/LD) | Actual Density (gm/cc) | Thermally accelerated Stress Crack resist (% failure @ hours) |
|---|---|---|---|
| HDPE - A and LDPE 2 | 85/15 | 0.323 | 90% <48 hours |
| HDPE - A and LDPE 1 | 70/30 | 0.361 | 90% <72 hours |
| HDPE - A and LDPE 1 | 70/30 | 0.360 | 100% <96 hours |
| HDPE - B and LDPE 3 | 85/15 | 0.330 | 0% @ 1400 hours |

Figure 6:
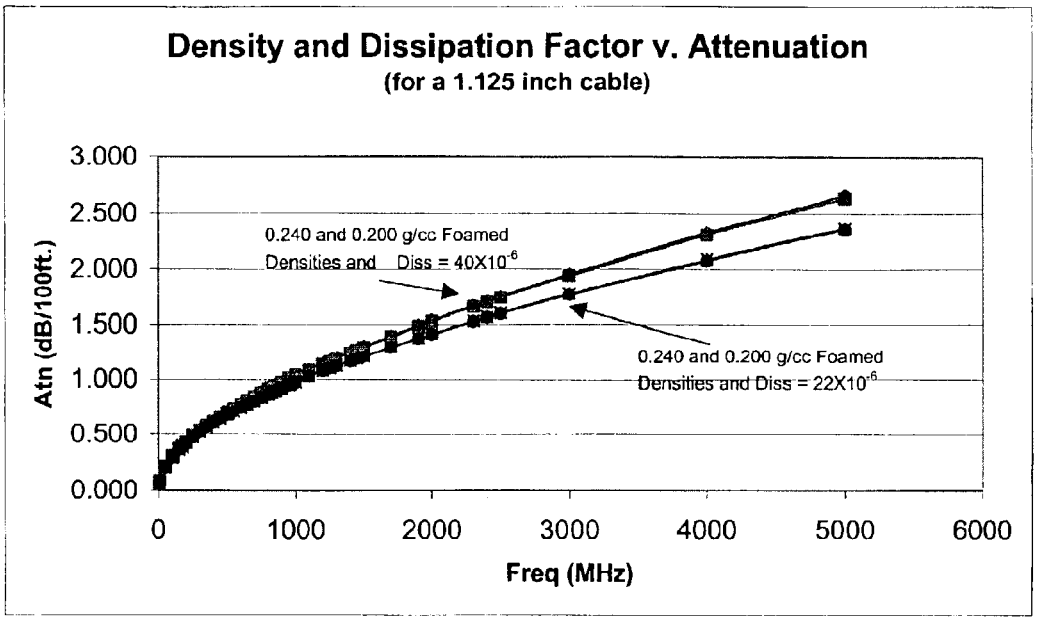
FIG. 6 is a graph showing how the attenuation in a cable is affected by the dissipation factor of the insulation composition.

The graph of FIG. 6 illustrates how the dissipation factor and density of the insulation material affects attenuation. The upper curve plots attenuation versus frequency for insulations formed of a polymer composition with a dissipation factor of $40\times10^{-6}$, which as been foamed to two different densities (0.240 g/cc and 0.200 g/cc). The plots for the two densities overlie one another. The second curve represents a resin with a reduced dissipation factor of $22\times10^{-6}$, also foamed to the same two densities. It will be seen that a reduction in dissipation factor provides a very significant reduction in attenuation at higher frequencies. While the plots for the two densities appear to overlie one another in this particular wide scale graphical view, a zoomed scale reveals that the lower density has a slight, but advantageously lower attenuation. The present invention makes it possible to produce a high quality, environmentally stable, low density closed cell foam structure with a reduced dissipation factor and correspondingly reduced attenuation.

These discoveries and their subsequent experimental practice teach us that the desirous combinations of high stress crack resistance, low attenuation (dissipation factor and density), low cost (density), and stable, small and closed cell foamed extrusion can be achieved on a consistent and repeatable basis, owing to the novel combinations of the aforementioned materials.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An electrical communications element comprising a conductor and a surrounding foamed plastic insulation, said foamed plastic insulation comprising a blend of less than 20% by weight of a polymer having an ultra-high die swell ratio greater than 55% and at least one additional polymer composition having a high thermally accelerated stability as defined by an oxidative induction time (OIT) of greater than 15 minutes at 200° C. according to ASTM method 4568.

2. A twisted pair cable comprising at least two twisted pairs of insulated electrical conductors, wherein the electrical communications element of claim 1 defines each said insulated electrical conductor.

3. The electrical communications element according to claim 1 wherein said at least one additional polymer has an oxidative induction time of greater than 20 minutes.

4. The electrical communications element according to claim 1 wherein said insulation has a thermally accelerated stress crack resistance of greater than 100 hours at 100° C. while coiled at a stress level of 1 times the insulation outside diameter without exhibiting radial or longitudinal cracks.

5. The electrical communications element according to claim 1 wherein said at least one additional polymer has a dissipation factor lower than that of said ultra high die swell ratio polymer and less than 75 micro radians.

6. The electrical communications element according to claim 5 wherein said at least one additional polymer has a dissipation factor less than 50 micro radians.

7. The electrical communications element according to claim 1 wherein said at least one additional polymer having a high thermally accelerated stability as defined by an oxidative induction time (OIT) of greater than 15 minutes at 200° C. according to ASTM method 4568 also has a dissipation factor less than 75 micro radians.

8. The electrical communications element according to claim 7 wherein said at least one additional polymer is a highly stabilized polyolefin a including phenolic antioxidants or phenolic antioxidant-phosphite blends as well as a hindered amine light stabilizer.

9. The electrical communications element according to claim 1 wherein said foamed plastic insulation comprises about 15% by weight of an olefin polymer having a die swell ratio greater than 55%.

10. The electrical communications element according to claim 1 wherein said polymer having a die swell ratio greater than 55% is a low density polyethylene and said at least one additional polymer having a high thermally accelerated stability defined by an oxidative induction time (OIT) of greater than 15 minutes at 200° C. according to ASTM method 4568 is a polyolefin composition.

11. The electrical communications element according to claim 10 wherein said at least one additional polyolefin composition has a dissipation factor lower than that of said low density polyethylene and less than 75 micro radians.

12. A coaxial cable comprising a cable core including a center conductor and a surrounding dielectric and an outer conductor surrounding said cable core, and wherein the electrical communications element of claim 1 defines said cable core.

13. An electrical communications cable comprising a conductor and a surrounding foamed plastic insulation, said foamed plastic insulation comprising a blend of a first polyolefin having an ultra high die swell ratio greater than 55% present in an amount less than 20% by weight and at least one additional polyolefin having a high environmental stability as defined by an oxidative induction time (OIT) of greater than 15 minutes at 200° C. according to ASTM method 4568.

14. The electrical communications cable according to claim 13 wherein said communications cable has a thermally accelerated stress crack resistance of greater than 100 hours at 100° C. while coiled at a stress level of 1 times the insulation outside diameter without exhibiting radial or longitudinal cracks.

15. The electrical communications cable according to claim 13 wherein said at least one additional polyolefin has a dissipation factor lower than the said ultra high die swell ratio polyolefin and which is less than 75 micro radians.

16. The electrical communications cable according to claim 15 wherein said at least one additional polyolefin is a highly stabilized polyolefin including phenolic antioxidants or phenolic antioxidant-phosphite blends as well as a hindered amine light stabilizer.

17. The electrical communications cable according to claim 13 wherein the blend of said first polyolefin and said at least one additional polyolefin exhibits an oxidative induction time (OIT) of greater than 15 minutes at 200° C. according to ASTM method 4568.

18. The electrical communications cable according to claim 17 wherein said blend exhibits an oxidative induction time of 20 minutes or greater.

19. An electrical communications cable comprising a conductor and a surrounding foamed plastic insulation, said foamed plastic insulation comprising a blend of a first polyolefin having an ultra high die swell ratio greater than 55% present in an amount less than 20% by weight and a highly stabilized polyolefin containing phenolic antioxidants or phenolic antioxidant-phosphite blends together with a hindered amine light stabilizer.

20. The electrical communications cable according to claim 19 wherein the communications cable has a thermally accelerated stress crack resistance of greater than 100 hours at 100° C. while coiled at a stress level of 1 times the insulation outside diameter without exhibiting radial or longitudinal cracks.

21. The electrical communications cable according to claim 19 wherein the blend exhibits an oxidative induction time (OIT) of greater than 15 minutes at 200° C. according to ASTM method 4568.

22. The electrical communications cable according to claim 19 wherein the blend exhibits a dissipation factor less than 75 micro radians.

23. The electrical communications cable according to claim 19 wherein the ultra-high die swell ratio first polyolefin is about 15% by weight of said blend.

24. The electrical communications cable according to claim 23 wherein the ultra-high die swell ratio first polyolefin is low density polyethylene.

* * * * *

UNITED STATES PATENT AND TRADEMARK OFFICE

CERTIFICATE OF CORRECTION

PATENT NO. : 6,858,805 B2
DATED : February 22, 2005
INVENTOR(S) : Blew et al.

It is certified that error appears in the above-identified patent and that said Letters Patent is hereby corrected as shown below:

Title page,
Item [57], ABSTRACT,
Line 3, after "with" insert -- no --.

Signed and Sealed this

Seventeenth Day of May, 2005

JON W. DUDAS
*Director of the United States Patent and Trademark Office*